United States Patent [19]

Hewitt

[11] 4,093,369

[45] June 6, 1978

[54] CLEANING SYSTEM

[75] Inventor: Robert E. Hewitt, Ontario, N.Y.

[73] Assignee: Xerox Corporation, Stamford, Conn.

[21] Appl. No.: 778,905

[22] Filed: Mar. 18, 1977

[51] Int. Cl.[2] ..... G03G 21/00

[52] U.S. Cl. ..... 355/15; 15/1.5 R; 15/301; 118/652

[58] Field of Search ..... 355/15, 3 R; 15/1.5 R, 15/256.51, 256.52; 118/652; 15/301, 345, 347; 55/DIG. 29

[56] References Cited

U.S. PATENT DOCUMENTS

| | | | |
|---|---|---|---|
| 3,590,412 | 7/1971 | Gerbasi | 355/15 X |
| 3,932,910 | 1/1976 | Shimoda | 355/15 X |
| 3,969,785 | 7/1976 | Ogawa et al. | 355/15 X |

*Primary Examiner*—Richard L. Moses

*Attorney, Agent, or Firm*—J. J. Ralabate; C. A. Green; H. Fleischer

[57] ABSTRACT

An apparatus in which particles are removed from a surface and collected. The particles are dislodged from the surface and move through a conduit to a storage housing. As the particles pass through the conduit, the particles are maintained spaced from the interior surface of the walls thereof.

10 Claims, 3 Drawing Figures

CLEANING SYSTEM

BACKGROUND OF THE INVENTION

This invention relates generally to an electrophotographic printing machine, and more particularly concerns a cleaning system employed therein.

In the process of electrophotographic printing, for example, as disclosed in U.S. Pat. No. 2,297,691 issued to Carlson in 1942, a photoconductive member is charged to a substantially uniform level. The light image of an original document being reproduced is projected onto the charged photoconductive member selectively dissipating the charge thereon. This records a latent image of the original document on the photoconductive member. Thereafter, a developer mixture of carrier granules and toner particles is brought into contact with the latent image. The latent image electrostatically attracts the toner particles from the carrier granules in image configuration. The developed toner powder image is then transferred to a sheet of support material such as paper, and permanently affixed thereto to form a permanent copy of the original document.

During the transfer step, substantially all of the toner particles are caused to adhere to the sheet of support material forming the informational areas thereon. However, a small portion of the toner particles frequently remain on the photoconductive member. This small quantity of toner particles remaining on the photoconductive member will affect subsequent operation of the electrophotographic process. If these toner particles remain thereon, they will have a cumulative affect in that additional residual toner particles will adhere more readily to the photoconductive member in both the image and non-image area thereof.

Typically, a rotating brush in peripherial contact with the surface of the photoconductive member is employed to clean residual toner particles adhering thereto. The brush, in turn, may be cleaned by a flicker bar and by a vacuum system similar in structure to the common household vacuum cleaner. The residual toner particles are entrained in the air and then removed therefrom by a suitable filter in the cleaning system.

One disadvantage that a system of this has type is high air flows must be maintained to keep that the residual toner particles airborne. This has necessarily led to a large and complicated vacuum system increasing the cost and decreasing the reliability of the electrophotographic printing machine. More particularly, the blower requires excessive power to develop the high air velocities required to maintain the toner particles airborne. If a high air velocity is not maintained, the toner particles will settle to the bottom of the tubing and will not be removed from the printing machine. This imposes the requirement of a large air moving system to advance these fine toner particles. Systems of this type are extremely noisey and consume excessive power. Thus, it would be extremely advantageous to be able to develop a low velocity air cleaning system.

Accordingly, it is a primary object of the present invention to improve the cleaning system employed in an electrophotographic printing machine.

SUMMARY OF THE INVENTION

Briefly stated and in accordance with the present invention, there is provided an apparatus for removing and collecting particles from a surface.

Pursuant to the features of the invention, there is provided means for dislodging the particles from the surface. Means are provided for storing the dislodged particles. A particle tight conduit is operatively connected to the dislodging means for conducting the particles to the storing means. Moving means move particles from the dislodging means through the conduit to the storing means. Means maintain the particles passing through the conduit spaced from the interior surface of the walls thereof.

BRIEF DESCRIPTION OF THE DRAWINGS

Other objects and advantages of the present invention will become apparent upon reading the following detailed description and upon reference to the drawings in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
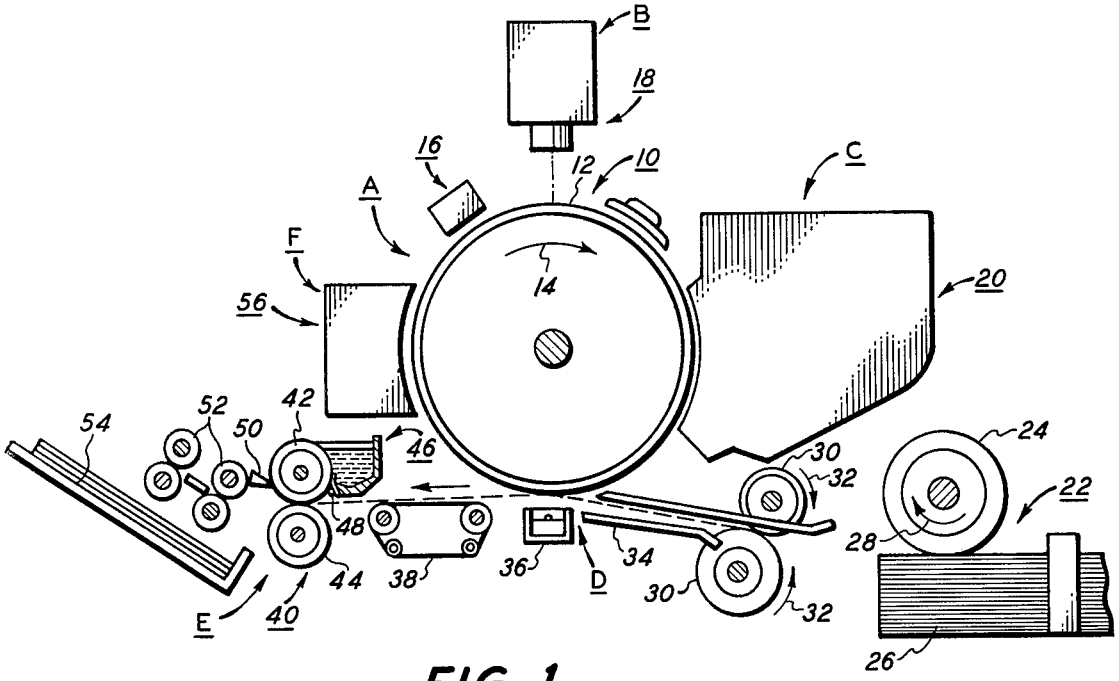
FIG. 1 is a schematic elevational view depicting an electrophotographic printing machine incorporating the features of the present invention therein.

For a general understanding of an electrophotographic printing machine in which the features of the present invention may be incorporated, reference is had to the FIG. 1 which depicts schematically the various components thereof. Hereinafter, like reference numerals will be employed throughout to designate identical elements. Although the cleaning apparatus of the present invention is particularly well adapted for use in an electrophotographic printing machine, it should become evident from the following discussion that it is equally well suited for use in a wide variety of devices and is not necessarily limited to the particular embodiments shown herein.

Inasmuch as the art of electrophotographic printing is well known, the various processing stations for producing a copy of an original document will be represented in FIG. 1 as blocks. Each of these blocks will be described briefly hereinafter.

Referring now to FIG. 1, the electrophotographic printing machine employs a drum 10 having a photoconductive surface 12 entrained about and secured to the exterior circumferential surface thereof. As drum 10 rotates in the direction of arrow 14, it passes through the various processing stations disposed about the periphery thereof. A suitable photoconductive material may be the type of selenium alloy described in U.S. Pat. No. 2,970,906 issued to Bixby in 1960.

Initially, drum 10 rotates a portion of photoconductive surface 12 through charging station A. Charging station A includes a corona generating device, indicated generally by the reference numeral 16, positioned closely adjacent to photoconductive surface 12. Corona generating device 16 charges photoconductive surface 12 to a relatively high substantially uniform potential. A suitable corona generating device is described in U.S. Pat. No. 2,836,725 issued to Vyverberg in 1958.

Next, the charged portion of photoconductive surface 12 is rotated to exposure station B. Exposure station B includes an exposure mechanism, indicated generally by the reference numeral 18, having a stationary housing for supporting an orginal document thereon. The housing comprises a transparent platen upon which the original document is positioned. Lamps illuminate the original document. Scanning of the original document is achieved by oscillating a mirror in a timed relationship with the movement of drum 10, or, in lieu thereof, by moving the lamp and lens system to form a flowing light image thereof. The light image of the orginal document is projected onto the charged portion of photoconductive surface 12. In this manner, photoconductive surface 12 is selectively irradiated to dissipate the charge thereon and record an electrostatic latent image corresponding to the informational areas contained within the original document.

Thereafter, the electrostatic latent image recorded on photoconductive surface 12 is rotated to development station C. At development station C, a developer unit 20 having a housing with a supply of developer mix contained therein renders the electrostatic latent image visible. The developer mix comprises carrier granules having toner particles adhering thereto. Generally, these carrier granules are formed from a magnetic material while the toner particles are usually a heat settable plastic. Preferably, developer unit 20 is a magnetic brush development system. In a system of this type, the developer mix is brought through a directional flux field forming a brush thereof. The brush of developer mix contacts the electrostatic latent image recorded on photoconductive surface 12. The latent image attracts electrostatically the toner particles from the carrier granules to form a toner powder image on photoconductive surface 12.

With continued reference to FIG. 1, a sheet of support material is advanced by sheet feeding apparatus 22 to transfer station D. Sheet feeding apparatus 22 includes a feed roll 24 contacting the upper surface of the stack of support material 26. Feed roll 24 rotates in the direction of arrow 28 to advance the uppermost sheet from stack 26. Registration rollers 30, rotating in the direction of arrow 32, align and forward the advancing sheet of support material. Sheet 34 receives the advancing sheet of support material and directs it into contact with drum 10 in a timed sequence so that the toner powder image developed thereon contacts the advancing sheet of support material at transfer station D.

Transfer station D includes a corona generating device 36. Corona generating device 36 sprays ions onto the side of the sheet of support material opposed from photoconductive surface 12. The toner power image adhering to photoconductive surface 12 is then attracted therefrom to the surface of the sheet of support material in contact therewith. After transferring the toner powder image to the sheet of support material, belt conveyor 38 advances the sheet of support material to fixing station E.

Fixing station E includes a fuser assembly, indicated generally by the reference numeral 40. Fuser assembly 40 heats the transferred powder image to permanently affix the toner particles to the sheet of support material. Preferably, fuser assembly 40 includes a fuser roll 42 and a back-up roll 44. The sheet of support material is interposed between fuser roll 42 and back-up roll 44. The toner powder image contacts fuser roll 42. Release material applicator 46 applies release material to fuser roll 42. Blade 48, closely adjacent to fuser roll 42, regulates the thickness of the layer of release material coating fuser roll 42. After the toner powder image is permanently affixed to the sheet of support material, stripper blade 50 separates the sheet from fuser roll 42. Thereafter, the sheet of support material is advanced by a series of rollers 52 to catch tray 54 for subsequent removal from the printing machine by the operator.

Invariably, residual toner particles remain adhering to photoconductive surface 12 after the transfer of the powder image to the sheet of support material. These residual toner particles are removed from photoconductive surface 12 and cleaning station F. Cleaning station F includes a cleaning mechanism, generally designated by the reference numeral 56, which dislodges and collects the residual toner particles adhering to photoconductive surface 12. The detailed structure of the cleaning system will be described hereinafter with reference to FIGS. 2 and 3.

It is believed that the foregoing description is sufficient for purposes of the present application to illustrate the general operation of an electrophotographic printing machine which exemplifiers one type of apparatus employing the present invention therein.

Figure 2:
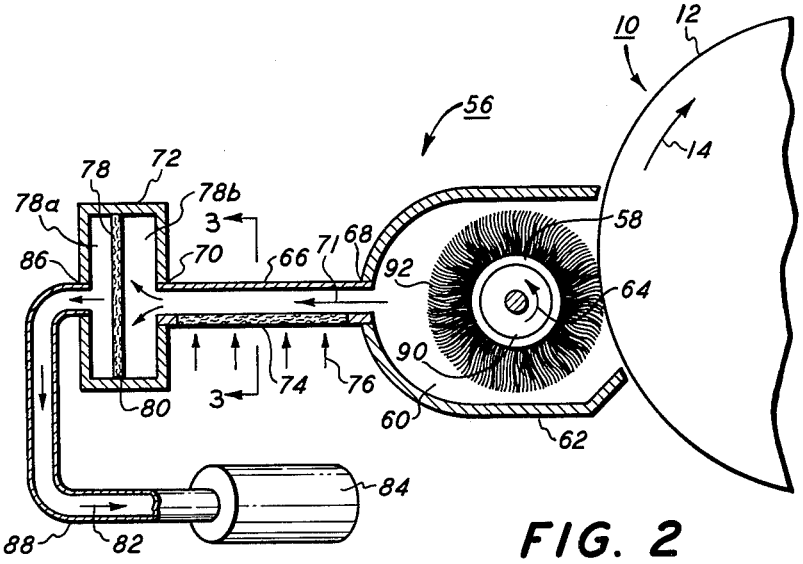
FIG. 2 is a schematic elevational view illustrating the cleaning system employed in the FIG. 1 printing machine.

Referring now to the specific subject matter of the present invention, FIG. 2 depicts cleaning mechanism 56 in detail. As shown therein, cleaning mechanism 56 includes a rotatable brush 58 of such construction as to apply extremely light pressure to photoconductive surface 12 of drum 10. Brush 58 is arranged to dislodge any residual toner particles that may be adhering to photoconductive surface 12. The cleaning of brush 58 is achieved by the flow of air around and through the pile of the brush. This flow of air will separate the toner particles from brush 58 and remove them from chamber 60 of housing 62. Brush 58 is arranged to rotate in the direction of arrow 64. Housing 62 supports brush 58 rotatably. Thus, the end regions of brush 58 are mounted in suitable bearings fixed in housing 62. In this manner, brush 58 may rotate in the direction of arrow 64. Vacuum duct 66 is connected to outlet port 68 of housing 62. The particles removed from brush 58 flow in the air stream in the direction of arrow 70 through duct 66. The opening at the opposite end of duct 66 is in communication with inlet port 70 of filter box 72. The lowermost portion 74 of duct 66 is made from an air pervious material. This permits air to flow therethrough in the direction of arrow 76. The construction of duct 66 and its relationship with air pervious member 74 is shown more clearly in FIG. 3 and will be described hereinafter in greater detail.

With continued reference to FIG. 2, filter box 72 defines a chamber 78 having compartments **78*a* and 78*b* therein. Air pervious member 80 or filter 80 divides chamber 78 into compartments 78*a* and 78*b*. Air pervious member 78 is a filter having a pore size smaller than the toner particles. Thus, the toner particles passing through duct 66 are entrapped in chambers 78*b* and stored therein for subsequent removal therefrom by the machine operator. However, air travels through filter 80 in the direction of arrows 82 to blower 84. Outlet port 86 of filter box 72 is coupled to vacuum duct 88. Vacuum duct 88, in turn, is coupled to blower 84. Vacuum duct 88 is made from a solid material. Only air flows through duct 88 in the direction of arrows 82**.

toner particles being entrapped in compartment 78*b*. Preferably, blower 84 includes a motor rotating a vaned member. By way of example, blower 84 develops a flow of about 60 cfm and a vacuum of about 1 to 2 inches of water. Thus, blower 84 is a motor driven fan unit connected to filter box 72 via duct 88. In this way, the air flows through filter box 72 drawing the air surrounding photoconductive surface 12 with the toner particles removed from photoconductive surface therethrough. The toner particles are separated from the air as it flows through filter 74. One type of suitable filter 80 is formed from an inner layer of glass wool fibers (fiberglass) loosely assembled into a web or mat of progressively greater density and an outer layer of loosely assembled glass wool fibers into a web or mat of substantially uniform density to form a self-sustaining structure. In this way, filter 80 forms a wall which is effective to filter the toner particles from the air flow. A suitable filter of this type may be manufactured by Modiglass Corporation, of Bremen, Ohio. By way of example, brush 58 includes a rotating substantially rigid cylindrical core 90 having fibers 92 extending radially outwardly therefrom and engaging photoconductive surface 12 of drum 10. A drive motor operates through a belt to rotate cylinder 90 at the desired speed, which may be about 20 to 25 linear feet per second. By way of example, fibers 92 may be made from a suitable synthetic material such as Nylon.

Figure 3:
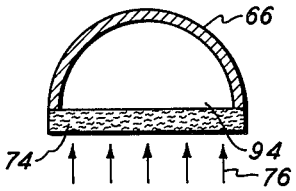
FIG. 3 is an enlarged sectional elevational view taken along the line 3—3 of FIG. 2.

Referring now to FIG. 3, the detailed structure of duct 66 and air pervious portion 74 thereof will be discussed thereof. As shown in FIG. 3, duct 66 is a elongated semi-cylindrical member preferably made from sheet metal or plastic. Thus, duct 66 is toner tight. The open end 94 thereof is closed by air pervious portion 74. Air pervious portion 74 is a flat member formed from a filtering medium of substantially uniform density. Preferably, the filtering medium is made from plastic beads one to two microns in diameter. The beads are heated to their fusion temperature and pressed into contact with one another forming the structure of air pervious portion 74. Alternatively, air pervious member 74 may be made from a sintered metal filter of the type manufactured by the Mott Metallurgical Corporation of Farmington, Connecticut. In this way, duct 66 forms an enclosure or tube with air passing through air pervious portion 74. Filter 74 is of a pore size such that the toner particles cannot pass therethrough. However, air flows therethrough in the direction of arrow 76 due to the pressure differential between the outside pressure and the interior thereof. This air flow prevents the toner particles from adhering to the interior surface of ducts 66. Without the air flow, the toner particles would naturally tend to fall out of the air stream under the influence of gravity and adhere to filter 74. However, inasmuch as air flows through filter 74, the toner particles are continuously maintained in a fluidized condition remaining in the air stream. This minimizes the air flow required to move the toner particles from housing 62 to filter box 72. It should be noted that filter 74 may be secured to duct 66 by a suitable adhesive, or in lieu thereof, by seals and fastening means such as screws threadedly engaging duct 66. In this manner, duct 66 forms a toner tight conduit having air flowing in an upwardly direction through the lowermost portion thereof maintaining the toner particles continuously in the air stream and preventing the toner particles from settling on the side walls of the conduit. Alternatively, the entire duct 66 may be a hollow tubular member made from an air pervious material.

In recapitulation, it is evident that the cleaning system of the present invention includes a brush for dislodging toner particles from a photoconductive surface and a conduit for transporting the dislodged toner particles from the photoconductive surface to a filter box for collection therein. The conduit is arranged to maintain toner particles in the air stream and prevent their adhering to the side walls thereof. This is achieved by having air flow through the lowermost portion of the conduit preventing the toner particles from settling thereon. A motor driven fan, i.e. a blower, maintains a suitable vacuum to insure the proper air flow.

It is, therefore, evident that there has been provided in accordance with the present invention, an apparatus for removing and collecting toner particles from the photoconductive surface. The apparatus of the present invention fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and varations as fall within the spirit and broad scope of the appended claims.

What is claimed is:

1. An apparatus for removing and collecting particles from a surface, including:

means for dislodging the particles from the surface;

means for storing the dislodged particles;

a particle tight conduit operatively connected to said dislodging means for conducting the dislodged particles from said dislodging means to said storing means;

means for moving the dislodged particles from said dislodging means through said conduit to said storing means; and means for maintaining the dislodged particles spaced from the interior surface of the walls of said conduit the movement of the dislodged particles therethrough.

2. An apparatus as recited in claim 1, wherein said moving means includes a blower for generating an air flow adapted to transport the particles from said dislodging means through said conduit to said storing means.

3. An apparatus as recited in claim 2, wherein said maintaining means includes a first air pervious member extending the length of said conduit at the lowermost portion thereof permitting air to flow therethrough into said conduit preventing the particles from settling on the interior surface of the walls thereof.

4. An apparatus as recited in claim 3, wherein said storing means includes:

a first housing defining a chamber having an inlet port coupled to said conduit and an outlet port coupled to said blower; and a second air pervious member disposed in the chamber of said housing between the inlet portion and outlet port to define two compartments with one compartment being coupled to the outlet port and the other compartment being coupled to the inlet port.

5. An apparatus as recited in claim 4, wherein said dislodging means includes:

a second housing defining a chamber coupled to said conduit; and a brush mounted rotatably in the chamber of said second housing and engaging the surface having the particles being dislodged thereon.

6. An electrophotographic printing machine of the type having residual toner particles adhering to a photoconductive member after transferring the toner power image to a sheet of support material, wherein the improvement includes:

means for dislodging the toner particles from the photoconductive member;

means for storing the dislodged toner particles;

a toner tight conduit operatively connected to said dislodging means for conducting the dislodged toner particles from said dislodging means to said storing means;

means for moving the dislodged toner particles from said dislodging means through said conduit to said storing means; and means for maintaining the dislodged toner particles spaced from the interior surface of the walls of said conduit during the movement of the dislodged toner particles therethrough.

7. A printing machine as recited in claim 6, wherein said moving means includes a blower for generating an air flow adapted to transport the toner particles from said dislodging means through said conduit to said storing means.

8. A printing machine as recited in claim 7, wherein said maintaining means includes a first air pervious member extending along the length of said conduit at the lowermost portion thereof permitting air to flow therethrough into said conduit preventing the toner particles from settling on the interior surface thereof.

9. A printing machine as recited in claim 8, wherein said storing means includes:

a first housing defining a chamber having an inlet port coupled to said conduit and an outlet port coupled to said blower; and a second air previous member disposed in the chamber of said housing between the inlet port and outlet port to define two compartments with one compartment being coupled to the outlet port and the other compartment being coupled to the inlet port.

10. A printing machine as recited in claim 9, wherein said dislodging means includes:

a second housing defining a chamber coupled to said conduit; and a brush mounted rotatably in the chamber of said second housing and engaging the photoconductive member having the toner particles being dislodged thereon.

* * * * *